US007047127B2

(12) United States Patent
Galtier

(10) Patent No.: US 7,047,127 B2
(45) Date of Patent: May 16, 2006

(54) METHOD AND DEVICE FOR DETERMINING THE INITIAL ANGLE POSITION OF AN INTERNAL COMBUSTION ENGINE

(75) Inventor: Frederick Galtier, Montpellier (FR)

(73) Assignee: Siemens Aktiengesellschaft, Munich (DE)

( * ) Notice: Subject to any disclaimer, the term of this patent is extended or adjusted under 35 U.S.C. 154(b) by 492 days.

(21) Appl. No.: 10/601,202

(22) Filed: Jun. 23, 2003

(65) Prior Publication Data

US 2004/0074289 A1 Apr. 22, 2004

(30) Foreign Application Priority Data

Jun. 24, 2002 (DE) ..... 102 28 147

(51) Int. Cl.
*F02D 41/00* (2006.01)

(52) U.S. Cl. ..... 701/113; 73/116

(58) Field of Classification Search ..... 701/113, 701/102; 73/117.3, 116; 123/491, 406.53, 123/406.59

See application file for complete search history.

(56) References Cited

U.S. PATENT DOCUMENTS 5,209,202 A * 5/1993 Maurer et al. ..... 123/406.59
5,434,800 A * 7/1995 Davis et al. ..... 701/113
5,562,082 A * 10/1996 Norppa et al. ..... 123/406.53
5,671,145 A * 9/1997 Krebs et al. ..... 701/102
5,970,784 A * 10/1999 Genin ..... 73/117.3
2004/0020472 A1 * 2/2004 Bayerle et al. ..... 123/491

FOREIGN PATENT DOCUMENTS

DE 40 05 123 A1 * 8/1991

* cited by examiner

*Primary Examiner*—Hieu T. Vo
(74) *Attorney, Agent, or Firm*—Morrison & Foerster LLP

(57) ABSTRACT

A method and device in which teeth or gaps of a pickup wheel passing a crankshaft sensor are counted constantly, i.e. even when the internal combustion engine is switched off and the stored number of teeth is used to determine the initial angle position of the internal combustion engine. A crankshaft sensor is used for this purpose, which is suitable for static detection of the teeth or gaps of the pickup wheel.

5 Claims, 2 Drawing Sheets

METHOD AND DEVICE FOR DETERMINING THE INITIAL ANGLE POSITION OF AN INTERNAL COMBUSTION ENGINE

CLAIM FOR PRIORITY

This application claims priority to German Application No. 10228147.5 which was filed on Jun. 24, 2002, which is hereby incorporated by reference.

TECHNICAL FIELD OF THE INVENTION

The invention relates to a method and a device for determining the angle position of a reciprocating internal combustion engine, the operation of which is controlled by an electronic operation control device.

BACKGROUND OF THE INVENTION

An important prerequisite for correct regulation of the operation of such an internal combustion engine is its synchronization. For this purpose the angles of rotation of the crankshaft and the camshaft are generally monitored using a crankshaft sensor with an assigned toothed pickup wheel and a camshaft sensor with an assigned pickup wheel, in order to determine the angle position of the internal combustion engine from these. GB 2,065,310; EP 0 310 823; WO 89 04 426 and U.S. Pat. No. 4,766,359 also disclose such combustion engines.

Much effort has been made to minimize the startup time required to start the internal combustion engine. One design used for this purpose is a specifically configured camshaft pickup wheel ("fast start camshaft"), which has a number of asymmetrically configured toothed rims. Using a specifically configured camshaft pickup wheel is however complex and expensive.

Another option for determining the initial angle position of the internal combustion engine makes use of the fact that an internal combustion engine always remains in specific discrete angle positions after being switching off when the clutch is disengaged. This fact is used in conjunction with the signals from conventional crankshaft and camshaft sensors to estimate the initial angle position of the internal combustion engine when the engine restarts. However, the accuracy of this method is limited, as it determines a more or less broad angle position range, not the precise angle position of the internal combustion engine. Additionally, errors in the determination of the initial angle position are unavoidable, if the internal combustion engine is operated after being switched off with the clutch engaged, as may be the case when parking the associated vehicle on a slope.

SUMMARY OF THE INVENTION

The present invention relates to a method and a device for determining the angle position of a reciprocating internal combustion engine, with which the angle position of the internal combustion engine can be determined with a high level of accuracy and as simply as possible after being switched off and when it is started up again.

One embodiment of the invention uses recently developed sensors, which allow static detection of the teeth and/or gaps in a pickup wheel, i.e. that unlike conventional crankshaft and camshaft sensors supply a reliable signal even at extremely low rotation speeds and even when stationary. Sensors based on the Hall effect (Hall-IC) are known for example, which can detect the difference in height between teeth and gaps on a toothed pickup wheel, even when the pickup wheel is stationary. Sensors, which respond to other different characteristics of the pickup wheel, such as the smallest movements, passage of a toothed rim, etc. are also suitable. The sensors used according to the invention can also detect extremely slow rotational movements or changes in the angle position of the crankshaft pickup wheel, in order to be able to count the teeth or gaps on the pickup wheel individually, as they pass the sensor.

Preferably, the electronic operation control device is operated so that it counts the teeth or gaps passing the crankshaft sensor even when the internal combustion engine is switched off. This ensures that precise determination of the initial angle position of the internal combustion engine is possible, even if the internal combustion engine is moved for example after switching off with the clutch engaged.

In one embodiment, operation of the electronic operation control device is for a component of the electric operation control device used to analyze the signals from the crankshaft sensor to be kept in constant operation, in other words to remain constantly in a sort of monitoring mode, even when the operation control device is in the power latch phase or switch-off phase. This can be achieved without any problems with standard electronic operation control devices.

In another embodiment, counting the teeth or gaps in the pickup wheel even when the internal combustion engine is switched off is for the entire operation control device to be switched off in the conventional manner when the internal combustion engine is switched off but for the operation control device to include an alarm device, which activates the component of the electronic operation control device used to analyze the signals from the crankshaft sensor, when the crankshaft sensor indicates that rotational movement of the crankshaft is taking place.

According to the invention, rotational movements of the crankshaft are monitored and detected constantly regardless of the operational status of the internal combustion engine and the electronic operation control device, allowing very precise determination of the angle position of the internal combustion engine when it is started up again.

The precise identified initial angle position of the internal combustion engine can then for example be used to improve and accelerate the startup phase of the internal combustion engine. In particular, the invention allows better and faster synchronization of the internal combustion engine, which can be used for example for more specific fuel injection during startup, to detect an angle adjustment of the camshaft, etc. Precise synchronization during startup of the internal combustion engine allows a significant improvement in the operation of the operation control device, the operational response of the associated vehicle, the reduction of pollutant emissions and fuel consumption, etc. (It is known that the majority of pollutant emissions are generated in the first few minutes of operation of the internal combustion engine).

A further advantage of the invention is that a separate camshaft sensor is not essential for determining the initial angle position of the internal combustion engine. If a camshaft sensor is still used however, simple pickup wheel structures are generally adequate, contributing to a reduction in manufacturing costs.

BRIEF DESCRIPTION OF THE DRAWINGS

Further details of the invention are disclosed in the description below in conjunction with the attached drawings, in which.

DETAILED DESCRIPTION OF THE INVENTION

Figure 1:
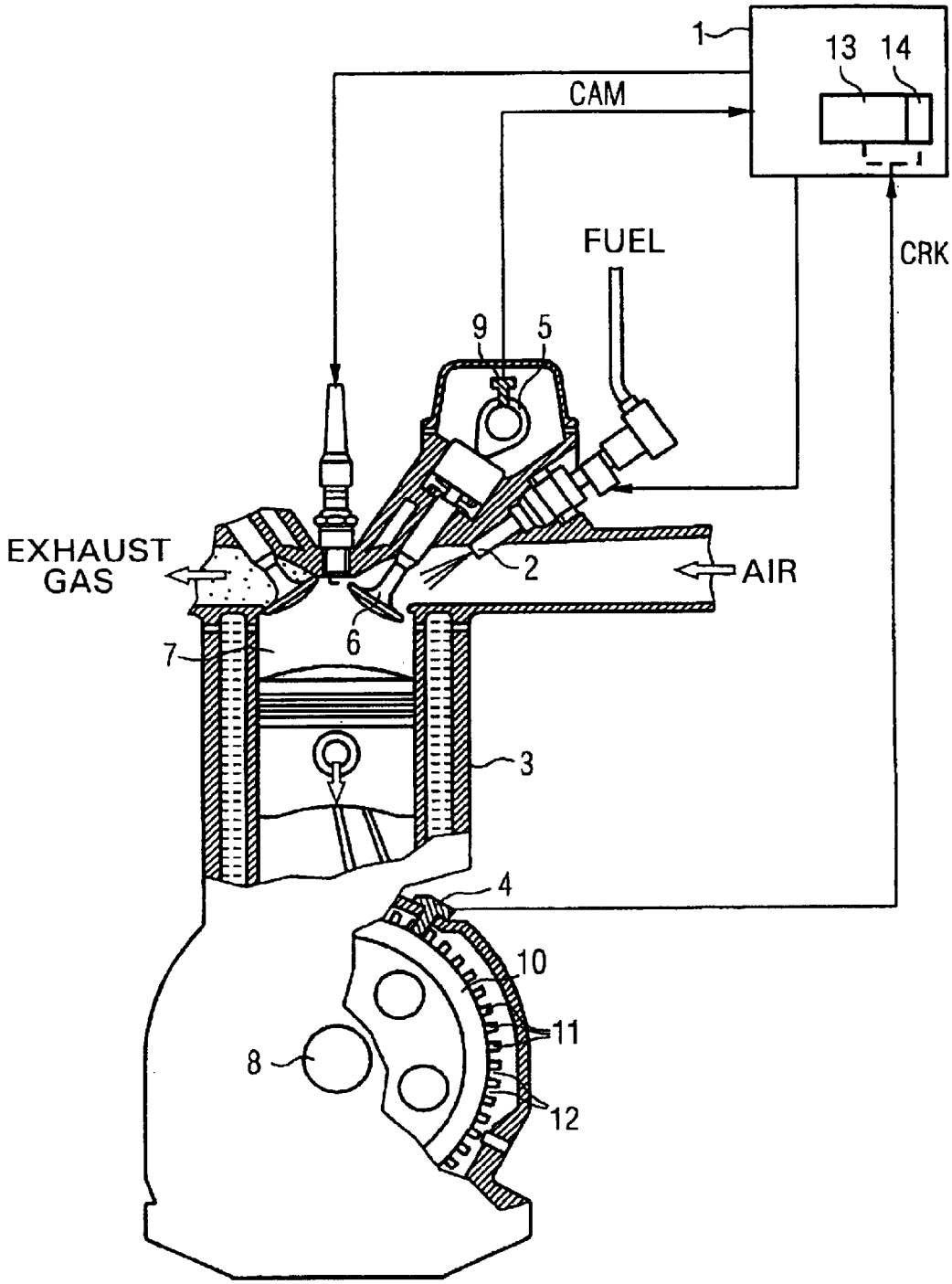
FIG. 1 shows a partial section of a front view of part of an internal combustion engine.

The internal combustion engine according to FIG. 1, which is configured for example as a four-cylinder gas motor with gas injection, is fitted with an electronic operation control device 1 (ECU), which regulates the ignition, fuel injection and other processes of the internal combustion engine. As indicated, the cylinder 7 is assigned an inlet valve 6, an outlet valve, a spark plug and an injection valve 2.

The crankshaft 8 is connected in a non-rotating manner to a pickup wheel 10, which has teeth 11 on its circumference, which are separated by gaps 12. The pickup wheel 10 is assigned a crankshaft sensor 4. The camshaft 5, which controls the inlet valves 6 and rotates at half the speed of the crankshaft 8, is also assigned a camshaft sensor 9. It should however be noted that the camshaft sensor 9 is not essential for the inventive method.

Figure 2A:
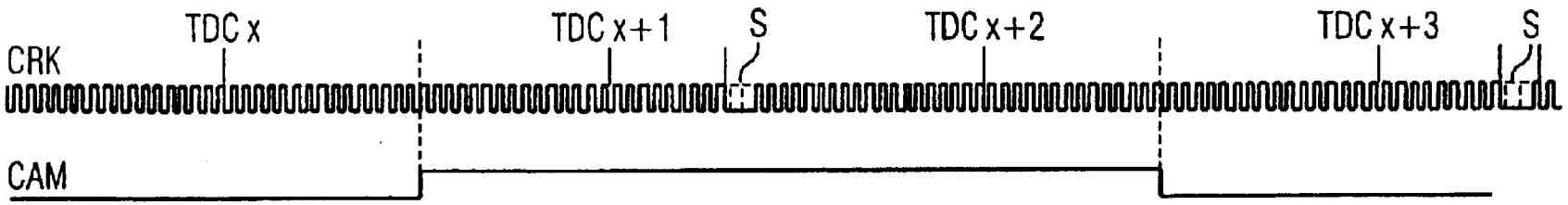
FIG. 2*a* shows a signal CRK of a crankshaft sensor and a signal CAM of a camshaft sensor.
Figure 2B:
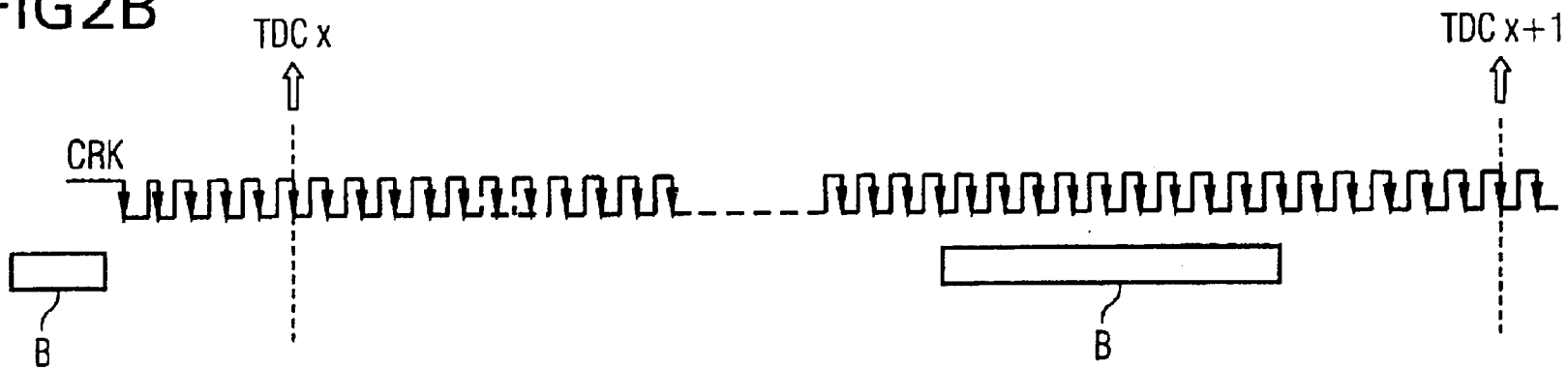
FIG. 2*b* shoes an enlargement of the signal CRK.

For explanatory purposes, a crankshaft signal CRK is shown in FIG. 2, as emitted by a conventional crankshaft sensor. Each pulse of the crankshaft signal CRK corresponds to a tooth of the associated pickup wheel, with every double tooth gap after 60 teeth serving as the synchronization pulse S for a full rotation of the crankshaft 8. The upper dead points $TDC_x$, $TDC_{x+1}$, etc. of the internal combustion engine are also shown in FIG. 2*a*.

FIG. 2*a* also shows a camshaft signal CAM, as generated by a conventional camshaft sensor. The camshaft signal CAM has two different levels, which are assigned to two successive rotations of the crankshaft. The camshaft signal CAM and the crankshaft signal CRK together with the synchronization pulses S therefore allow assignment of the crankshaft position in the working cycle during normal operation of the internal combustion engine.

The signals CRK and CAM of conventional sensors however do not allow determination of the initial angle position of the internal combustion engine, as the crankshaft and camshaft sensors used in practice to date cannot supply a signal when the rotational movements of the crankshaft or camshaft are too slow. As indicated by rectangles in FIG. 2*b*, an internal combustion engine generally remains within specific angle position ranges B after being switched off. Several known methods for determining the initial angle position or for synchronizing the internal combustion engine make use of this fact, even though it has the disadvantages described above.

According to the invention, however, a crankshaft sensor 4 is used which allows static detection of the teeth 11 or gaps 12 on the pickup wheel 10. In other words, it can be used even at very low rotation speeds and even when the crankshaft 8 is stationary. A Hall sensor is used as the crankshaft sensor 4 for example and this detects the difference in height between tooth 11 and gap 12 on the pickup wheel.

The operation control device can then use this crankshaft signal CRK to count the teeth 11 or gaps 12, as they pass the crankshaft sensor 4 after a synchronization pulse S. In order to ensure that every rotational movement and even the smallest rotational movements of the pickup wheel 10 are taken into account, the component 13 of the operation control device 1 used to analyze the crankshaft signal CRK is preferably not switched off, but remains constantly in a monitoring mode (watch guard mode), even if the internal combustion engine runs down or stops or if the operation control device 1 is in power latch or switch-off phase. The number of teeth 11 or gaps 12 passing since the synchronization pulse S is stored and then allows precise determination of the initial angle position of the crankshaft or the internal combustion engine.

Instead of keeping the component 13 of the operation control device 1 in constant operation, the component 13 can be switched on and off with the remainder of the operation control device 1 in the conventional manner, if the component 13 is assigned an alarm device 14, which always activates the component 13, when the signal CRK indicates that rotation of the crankshaft 8 is taking place.

As stated above, the camshaft sensor 9 is not essential for the inventive method. In any case however the camshaft sensor 9 may have a very simple structural configuration.

What is claimed is:

1. A device for determining the angle position of a reciprocating internal combustion engine, comprising:

an electronic operation control device, which receives signals from a crankshaft sensor, which is assigned to a toothed pickup wheel connected in a non-rotating manner to the crankshaft and which is configured for static detection of the teeth and/or gaps on the pickup wheel, wherein the electronic operation control device constantly counts the teeth or gaps of the pickup wheel passing the crankshaft sensor with every rotational movement of the crankshaft, starting from a synchronization angle position of the pickup wheel, and stores a resulting number of teeth to determine the initial angle position of the internal combustion engine therefrom when the internal combustion engine starts up.

2. A method for determining the angle position of a reciprocating internal combustion engine with an electronic operation control device, which receives signals from a crankshaft sensor, which is assigned to a toothed pickup wheel connected in a non-rotating manner to the crankshaft and which is configured for static detection of the teeth and/or gaps on the pickup wheel, constantly counts the teeth or gaps of the pickup wheel passing the crankshaft sensor with every rotational movement of the crankshaft via the electronic operation control device, starting from a synchronization angle position of the pickup wheel; and storing a resulting number of teeth to determine the initial angle position of the internal combustion engine therefrom when the internal combustion engine starts up.

3. The method according to claim 2, wherein the electronic operation control device is operated so that it counts the teeth or gaps passing the crankshaft sensor when the internal combustion engine is switched off.

4. The method according to claim 3, wherein a component of the operation control device used to analyze the signals from the crankshaft sensor is kept in constant operation.

5. The method according to claim 3, wherein a component of the operation control device used to analyze the signals from the crankshaft sensor is switched off in a power latch and switch-off phases of the internal combustion engine together with a remainder of the electronic operation control device and activated again on based on an alarm signal, when the crankshaft sensor indicates rotational movement of the crankshaft.

* * * * *